US005970728A

United States Patent [19]

Hebert

[11] Patent Number: 5,970,728

[45] Date of Patent: Oct. 26, 1999

[54] MULTIPLE COMPRESSOR HEAT PUMP OR AIR CONDITIONER

[76] Inventor: Thomas H. Hebert, 1340 Eastwood Dr., Lutz, Fla. 33612

[21] Appl. No.: 09/058,632

[22] Filed: Apr. 10, 1998

[51] Int. Cl.[6] ..... F25B 13/00

[52] U.S. Cl. ..... 62/160; 62/324.6

[58] Field of Search ..... 62/324.1, 324.6, 62/160, 510, 228.5, 228.1

[56] References Cited

U.S. PATENT DOCUMENTS

| | | | |
|---|---|---|---|
| 1,891,538 | 12/1932 | Hicks . | |
| 2,124,291 | 7/1938 | Fleisher . | |
| 2,255,585 | 9/1941 | Hubacker . | |
| 2,350,408 | 6/1944 | McGrath | 62/510 |
| 2,351,695 | 6/1944 | Newton | 62/510 |
| 2,776,543 | 1/1957 | Ellenberger | 62/160 |
| 2,801,524 | 8/1957 | Fifield | 62/160 |
| 2,938,361 | 5/1960 | McNatt | 62/324.6 |
| 3,264,839 | 8/1966 | Harnish | 62/160 |
| 3,537,274 | 11/1970 | Tilney . | |
| 3,902,551 | 9/1975 | Lim et al. . | |
| 4,320,629 | 3/1982 | Nakagawa et al. . | |
| 4,375,753 | 3/1983 | Imasu et al. . | |
| 4,542,786 | 9/1985 | Anders . | |
| 4,574,868 | 3/1986 | Anders . | |
| 4,599,870 | 7/1986 | Hebert . | |
| 4,679,404 | 7/1987 | Alsenz | 62/175 |
| 4,873,837 | 10/1989 | Murray . | |
| 4,910,972 | 3/1990 | Jaster . | |
| 5,205,347 | 4/1993 | Hughes . | |
| 5,275,232 | 1/1994 | Adkins et al. . | |
| 5,345,778 | 9/1994 | Roberts . | |
| 5,465,591 | 11/1995 | Cur et al. . | |
| 5,485,732 | 1/1996 | Locatelli . | |
| 5,613,554 | 3/1997 | Bull et al. . | |

FOREIGN PATENT DOCUMENTS

| | | |
|---|---|---|
| 559983 | 9/1993 | European Pat. Off. . |
| 2056652 | 3/1981 | United Kingdom . |

*Primary Examiner*—William Doerrler
*Attorney, Agent, or Firm*—Stein, Schifino & Van der Wall

[57] ABSTRACT

In a refrigeration system, a multiple compressor system for maintaining the heat output constant while the outside ambient temperature continues to decrease. The present invention comprises of a primary compressor and at least one secondary compressor. The entire refrigeration system is sized for the primary compressor operating while in the cooling mode. In the heating mode, the primary compressor operates by itself until the outside ambient temperature falls to a temperature within a particular range. Once the predetermined temperature set point is met, a secondary compressor begins operating in conjunction with the primary compressor such that the mass flow of refrigerant through the system in the heating mode of operation is no greater than that of the primary compressor operating alone in the cooling mode. While the outside temperature continues to decrease, additional secondary compressors may be included to maintain a constant heat output. In the cooling mode, only a single compressor is required to operate the system. Each of the compressors may alternate with any other so that the lives of the compressors are preserved.

13 Claims, 5 Drawing Sheets

WARM HOUSE
AIR OUT TO
CONDITIONED SPACE
10
40
70
AIR IN FROM
CONDITIONED
SPACE
64
60
70
70
70
66
66
50
66
N
33
32
31
EXTRACTING
HEAT FROM OUTDOORS
70
20
62
60
62
60
COLD OUTDOORS
62
60

MULTIPLE COMPRESSOR HEAT PUMP OR AIR CONDITIONER

BACKGROUND OF THE INVENTION

1. Field of the Invention

The present invention relates to the use of multiple compressors to provide extra capacity in the heating mode at low ambient temperatures in reversible refrigeration systems (heat pumps). This invention more particularly pertains to utilizing a single or primary compressor above particular temperature set points determined as a function of a percentage of maxium allowable system design mass flow and then multiple compressors simultaneously in parallel to the primary compressor when below the particular temperature set points determined for each additional compressor while on the heating mode of operation such that the heat output remains constant at lower ambient temperatures. In the cooling mode and down to the first temperature set point on heating a primary compressor alternates with any one of a number of the secondary compressors in singular compressor operation to extend the life of the compressors.

2. Description of the Background Art

Presently, most commercially available multiple compressor systems use dual compressors only in the cooling mode where the second compressor is used primarily for extra cooling capacity at high ambient temperatures. These known dual compressor systems are used in the cooling mode only. Such a system requires an oversized condenser and evaporator compared to the primary compressor when in the first stage cooling mode. This is because when both compressors are running in the second stage cooling mode an increased mass flow of refrigerant is created through the entire system. In other words, the entire refrigeration system would have to be sized to accommodate the increased flow of refrigerant due to the existence of multiple compressors running simultaneously in parallel in the cooling mode at high ambient temperatures.

With regard to these known multiple compressor refrigeration systems, these systems are simply oversized, configured at a considerably higher cost and perform with high efficiency only when the primary or first stage compressor is running in the cooling mode. Moreover, the simultaneous use of multiple compressors in the cooling mode will likely reduce the life expectancy of the first stage compressor prior to the typical life expectancy of single compressor systems.

In response to the realized inadequacies of these earlier, multiple, compressor systems, it became clear that there is a need for a multiple compressor system capable of being utilized in both the heating and cooling modes of operation but which is sized for only a single compressor in the cooling mode. This device must provide for an increased mass flow of refrigerant at low outside ambient temperatures by providing multiple compressors such that the heat output remains equal to that of the primary compressor operating solely at higher outside ambient temperatures. However, while in the heating mode at higher ambient temperatures, a single, primary compressor dictates the component sizing of the overall refrigeration system. Moreover, the primary compressor is itself sufficient in the cooling mode. Thus, the device of the present invention may allow alternate use of compressors in the cooling mode to extend the life expectancy of the overall system. In as much as the art consists of various types of multiple compressor refrigeration systems, it can be appreciated that there is a continuing need for and interest in improvements to multiple compressor systems, and in this respect, the present invention addresses these needs and interests.

Therefore, the principal object of this invention is to provide an improvement which overcomes the aforementioned inadequacies of the prior art devices and provides an improvement which is a significant contribution to the advancement of refrigeration systems.

Another object of this invention is to provide a new and improved multiple compressor system for use in a refrigeration system that has all the advantages and none of the disadvantages of the earlier multiple compressor systems.

Another object of the present invention is to provide a multiple compressor system for maintaining a heat output at lower ambient temperatures.

Still another objective of the present invention is to provide a multiple compressor system compatible with a refrigeration system sized for the mass flow of a single compressor operating in the cooling mode at higher outside ambient temperatures.

Yet another objective of the present invention is to provide a multiple compressor system having a primary compressor operating above particular outside ambient temperature so points in the heating mode that are determined as a function of a percentage of maxium allowable system design mass flow and then having secondary compressors operate parallel to the primary compressor when the outside ambient temperatures fall below each of the particular temperature set points determined for each additional compressor.

Still a further objective of the present invention is to provide a multiple compressor system wherein the refrigeration system is sized for the mass flow of the primary compressor when operating in the cooling mode but the secondary compressors alternate with the primary compressor for singular operation in the cooling mode.

Yet a further objective is to provide in a refrigeration system of the type having a condenser, evaporator, refrigerant and the capabilities of at least heating and cooling modes of operation, a multiple compressor system in parallel operation comprising, in combination, a primary compressor and at least one secondary compressor, the condenser and evaporator sized for the maximum mass flow determined. for the primary compressor operating in the cooling mode, the primary compressor operating by itself when in the heating mode above the first temperature set point; the secondary compressor commencing operation in the heating mode of operation below that first temperature set point and concurrently operating with the primary compressor such that mass flow of the refrigerant through the refrigeration system in the heating mode of operation is no greater than the maximum mass flow determined for the primary compressor operating solely in the cooling mode of operation.

An additional objective is to provide in the method of operation of a refrigeration system of the type having a condenser, evaporator, refrigerant and the capabilities of at least heating and cooling modes of operation, the method comprising the steps of passing the refrigerant from the evaporator of the refrigeration system to a primary compressor in the heating mode of operation for compressing the refrigerant and supplying same to the condenser of the refrigeration system, the primary compressor operating exclusively in the heating mode of operation above a first temperature set points; controlling the exclusive operation of the primary compressor by selecting the temperature set point above which the primary compressor is the sole means for compressing refrigerant; and passing the refrigerant from the evaporator of the refrigeration system to the primary compressor and a secondary compressor while in the heating mode of operation and below the first temperature set point such that the mass flow of the refrigerant through the refrigeration system in the heating mode of operation is no greater than that maximum mass flow determined for the primary compressor operating solely in the cooling mode of operation.

Another objective is to provide in the method of operation of a refrigeration system, the method further comprising of the step of alternating exclusive operation in the cooling mode of operation of at least one of the secondary compressors with the primary compressor.

The foregoing has outlined some of the pertinent objects of the invention. These objects should be construed to be merely illustrative of some of the more prominent features and applications of the intended invention. Many other beneficial results can be obtained by applying the disclosed invention in a different manner or by modifying the invention within the scope of the disclosure. Accordingly, other objects and a more comprehensive understanding of the invention may be obtained by referring to the summary of the invention, and the detailed description of the preferred embodiment in addition to the scope of the invention defined by the claims taken in conjunction with the accompanying drawings.

SUMMARY OF THE INVENTION

The present invention is defined by the appended claims with the specific embodiment shown in the attached drawings. The present invention is directed to an apparatus that satisfies this need for the advantages of multiple compressors operating simultaneously at low ambient temperatures in the heating mode while maintaining a refrigeration system that is sized for the mass determined for a single compressor when it operates by itself at high ambient temperatures in the cooling mode. For the purpose of summarizing the invention, the invention comprises a refrigeration system sized for the mass flow determined for a single, primary compressor in the cooling mode of operation. The primary compressor exclusively operates in the heating mode above a particular temperature set point. Preferably, the temperature set point is that at which when the first secondary compressor mass flow is added to the primary compressor's mass flow the total mass flow is no greater than the maximum design flow for the system. However, below this particular temperature set point, additional temperature set points are determined by mass flow where additional set points secondary compressors can be added to the system to operate simultaneously with the primary compressor in the heating mode. As the outdoor ambient temperature falls below each predetermined particular temperature set point, the number of secondary compressors operating (in parallel) with the primary compressor increases. In other words, once dropping below each temperature set point, an additional secondary compressor begins operating in conjunction with the previously initiated compressors. However, in the refrigeration system of the present invention, the mass flow of refrigerant while in the heating mode of operation remains equal to or below that of the maximum mass flow determined for the cooling mode of operation.

An important feature of the present invention is that once the outside ambient temperature falls below the approximate temperature set point established for the exclusive operation of the primary compressor, the mass flow of refrigerant in the heating mode increases as a result of the operation of the secondary compressors in conjunction with the primary compressor. Moreover, the condenser and evaporator are sized for only a single compressor in the cooling mode of operation. Therefore, it can be readily seen that the present invention provides a means to maintain increased mass flow of refrigerant in the heating mode at lower outside ambient temperatures but no greater than the mass flow for a single compressor operating in the cooling mode. Thus, a multiple compressor system of the present invention would be greatly appreciated.

The foregoing has outlined rather broadly, the more pertinent and important features of the present invention. The detailed description of the invention that follows is offered so that the present contribution to the art can be more fully appreciated. Additional features of the invention will be described hereinafter. These form the subject of the claims of the invention. It should be appreciated by those skilled in the art that the conception and the disclosed specific embodiment may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more succinct understanding of the nature and objects of the present invention, reference should be directed to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
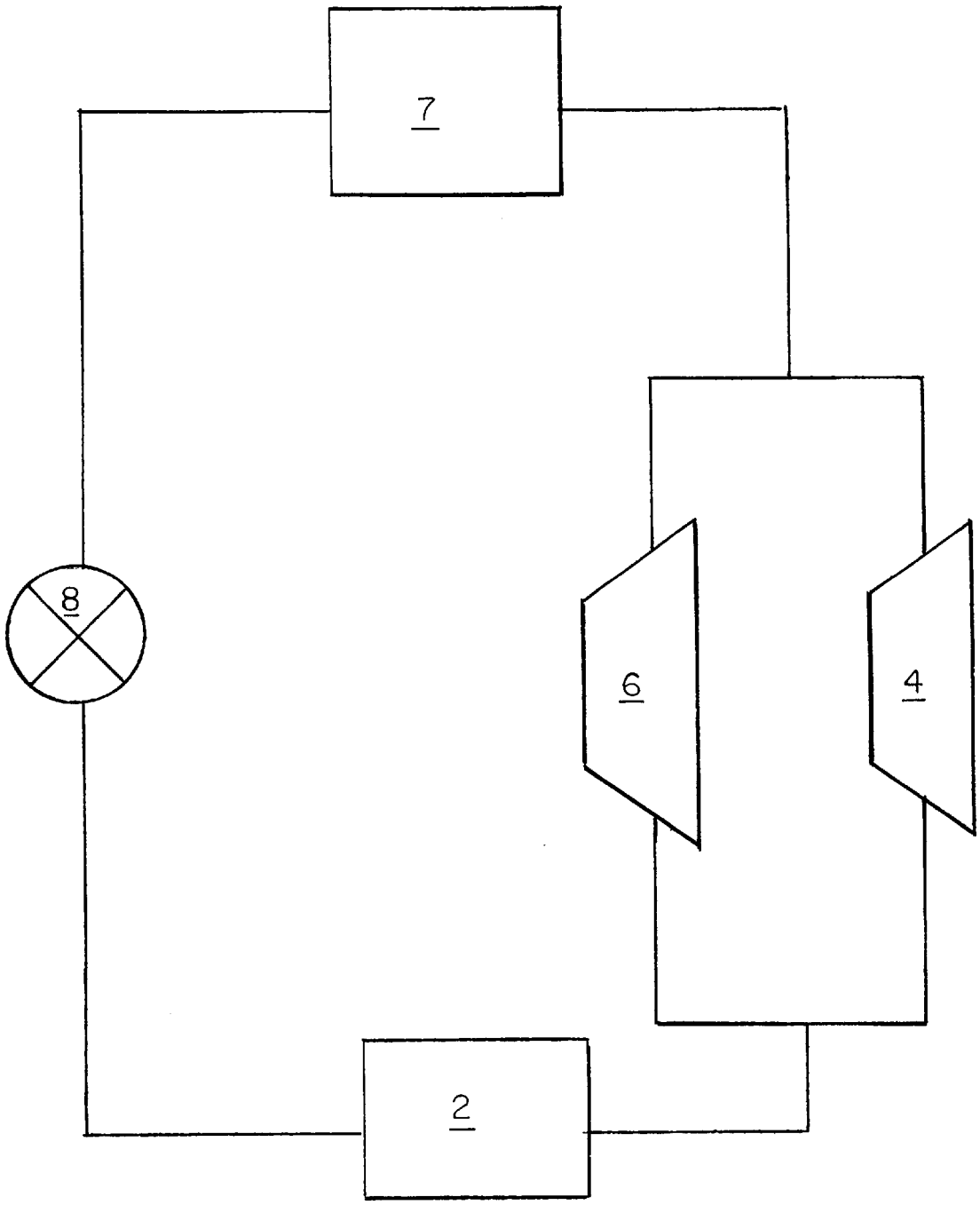
Fig. 1 PRIOR ART
FIG. 1 is prior art illustrating dual, parallel compressors in a reversible refrigeration system in the cooling mode.
Figure 2:
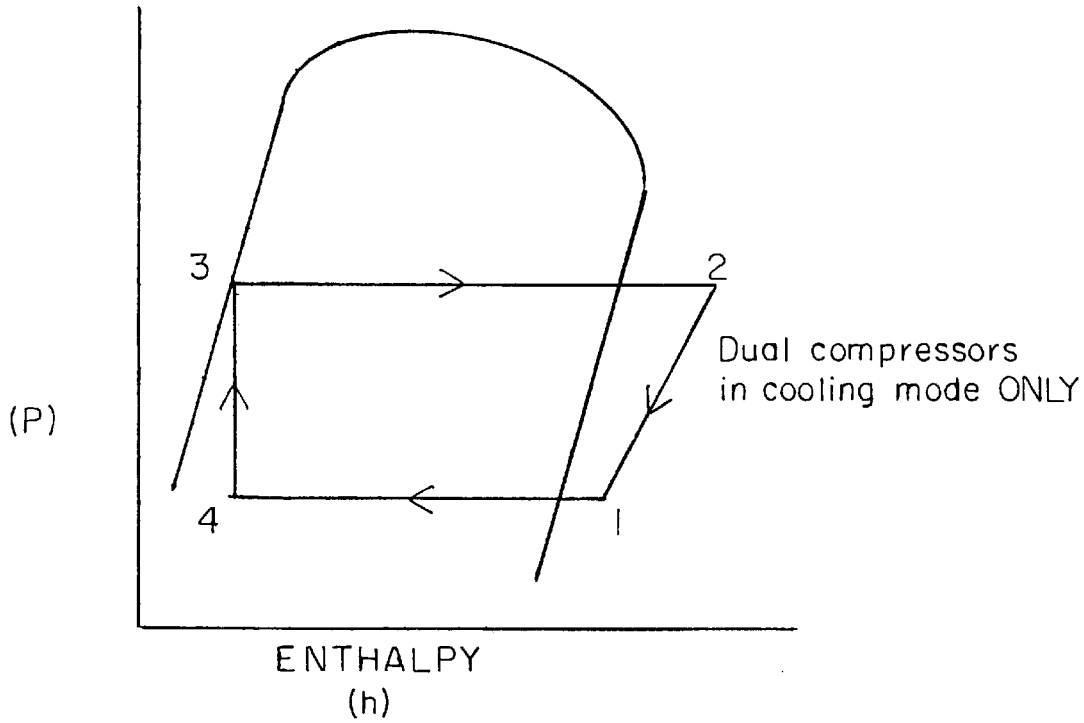
Fig. 2 PRIOR ART
FIG. 2 is a Pressure-Enthalpy diagram illustrating the process representation of the known art.
Figure 4:
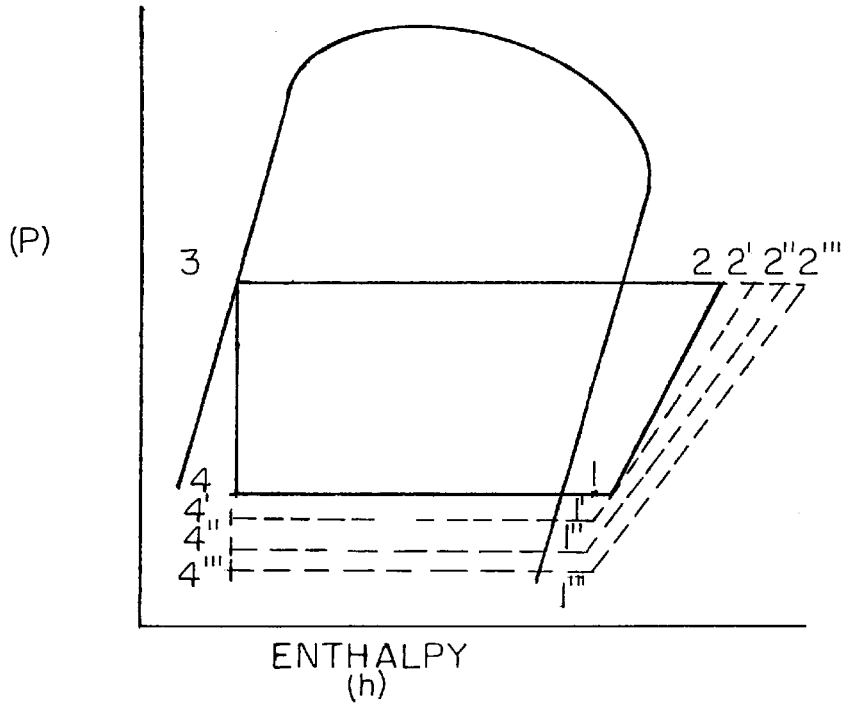
FIG. 4 is a Pressure-Enthalpy diagram illustrating the process representation of the present invention.
Figure 3:
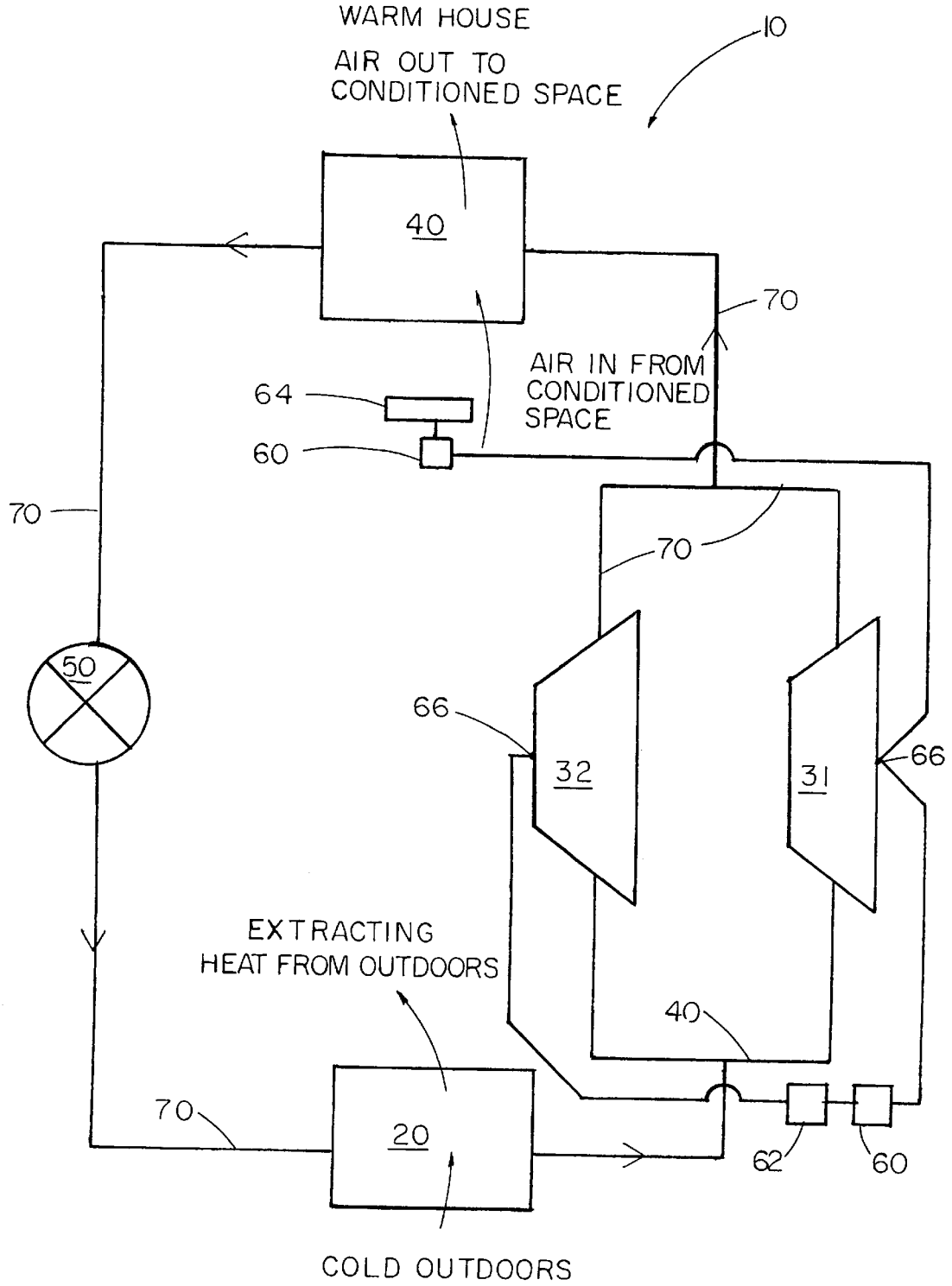
FIG. 3 is an illustration of one embodiment of the present invention having dual, parallel compressors in a reversible refrigeration system for simultaneous operation in the heating mode.

With reference to the drawings and in particular to FIGS. 3 and 4 thereof, a new and improved refrigeration system embodying the principles and concepts of the present invention and generally designated by the reference number 10 will be described. As shown in FIG. 1, a refrigeration system comprising of a pair of compressors 4 and 6, condenser 7, expansion valve 8 and an evaporator 2 is known for use in the cooling mode only. FIG. 2 illustrates this known process representation. Cycle 1-2-3-4-1 represents the thermodynamic steps characteristic of the typical dual compressor system while operating in the cooling mode.

As shown in FIG. 3, the preferred embodiment of the present invention comprises of a primary compressor 31 and a secondary compressor 32. The dual compressors 31 and 32 are in parallel communication with a condenser 40, an expansion valve 50, and an evaporator 20.

The dual compressors 31 and 32 operate in the cooling mode with only one of the two compressors running. The compressors 31 and 32 could alternate in the cooling mode in order to increase the life expectancy of the system. Moreover, one of any number of secondary compressors N could operate in place of the primary compressor 31 in the cooling mode when only the operation of a single compressor is desired in order to prolong the life of the primary compressor 31.

The refrigeration line sizes, evaporator 20, and condenser 40 are sized according to mass flow for one compressor running in the cooling mode. Simply, the refrigeration system of the present invention is sized for the primary compressor 31 while operating in the cooling mode.

This is different from conventional dual compressor technology where the line sizes and coils are sized for mass flow with both compressors running at high outdoor ambient temperatures in the cooling mode.

In the heating mode, for dual compressor operation of the present invention, the primary compressor 31 runs by itself, down to some predetermined outdoor temperature. Then the secondary compressor 32 is started, to bring mass flow and capacity back up to that experienced at temperatures higher than the predetermined outdoor temperature. This is the only time multiple compressors, namely the primary and secondary compressors 31 and 32, run concurrently with each other. The primary compressor 31 is brought on by the operation of an indoor thermostat 60. When the thermostat 60 calls for heat, the primary compressor 31 comes on only when above the preset outdoor temperature. The secondary compressor 32 is controlled first of all by the indoor thermostat 60. If the indoor thermostat 60 is not calling for heat, neither the primary compressor 31 nor the secondary compressor 32 will come on regardless of the outdoor temperature. If the indoor thermostat 60 is calling for heat, then the secondary compressor 32 will come on based on the action of an outdoor thermostat 60 (or it could be based on suction or high side refrigerant pressures).

In the preferred embodiment, the primary compressor 31 operates exclusively above an outdoor ambient temperature set point of 20° to 30° F. However, the particular temperature set point is effected by the typical climate of a particular geographic region and may fluctuate depending upon a myriad of conditions such as altitude. In the present invention, a secondary compressor 32 begins operation when the outdoor ambient temperature falls below the preset set point and operates in conjunction with the primary compressor 31. Each subsequent secondary compressor N begins operating in conjunction with the primary compressor 31 and the secondary compressor 32 at temperature set points determined for each additional compressor. For example, each subsequent secondary compressor begins operation at intervals of 20° to 30° F. below the first predetermined set point. In the case of only the primary compressor 31 and the secondary compressor 32 operating as described above, the secondary compressor 33 may begin operating at a temperature set point that is between 10 to −10° F. Each subsequent secondary compressor N may then begin operating with all the other compressors at temperature set point at intervals of approximately 20° to 30° F. below the 10° to −10° F. temperature range of the secondary compressor 33.

When the outdoor temperature drops below the outdoor thermostat set point which is within the above described temperature range of approximately 20° to 30° F., the secondary compressor 32 will come on after the time delay 62 has operated. The time delay 62 prevents both the primary compressor 31 and the secondary compressor 32 from coming on at the same time and creating a power spike. Therefore, the start amps are down. It is preferable to have a time delay of approximately 30 seconds to 1 minute. The secondary compressor 32 turn off set point is some number of degrees higher than the secondary compressor 32 turn on set point to prevent short cycling of the secondary compressor.

Figure 5:
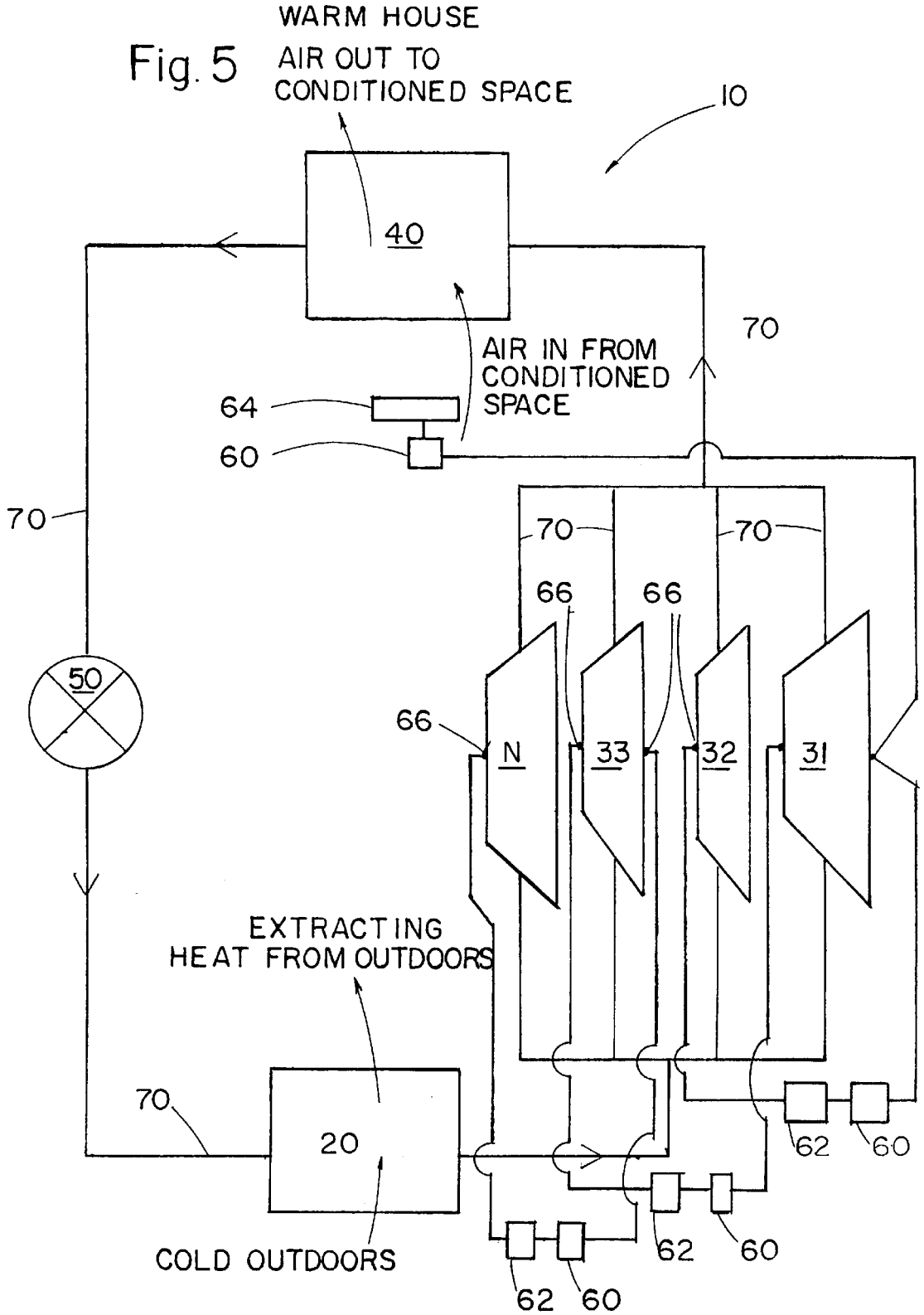
FIG. 5 is an illustration of one embodiment of the present invention having multiple secondary compressors in conjunction with a primary compressor.

All of this could be repeated with additional compressors N set up with their own outdoor thermostats 60 set for lower and lower temperatures and time delays 62. FIG. 5 illustrates a plurality of secondary compressors N capable of operating in conjunction with the primary compressor 31 in the heating mode at low ambient temperatures. FIG. 4 illustrates the process representation of multiple secondary compressors N operating in conjunction with the primary compressor 31.

Cycle 1-2-3-4-1 represents the thermodynamic characteristics of the typical dual compressor system while in the cooling mode. Cycle 1'-2'-3'-4'-1' represents the characteristics of the present invention comprising of a pair of compressors 31 and 32 operating in the heating mode as described above. Cycle 1"-2"-3"-4"-1" represents the characteristics of the present invention wherein there are two secondary compressors 32 and 33. Cycle $1^N$-$2^N$-$3^N$-$4^N$-$1^N$ represents the characteristics of the present invention where there are any number N of secondary compressors.

The benefit of the secondary compressor 32 or multiple secondary compressors N is a higher heating capacity at lower outdoor temperatures while maintaining a high coefficient of performance (COP) and with lower cost equipment since line and coil sizing is for mass flow of just one compressor operating in the cooling mode.

The use of the refrigeration system 10 as described above constitutes an inventive method in addition to the refrigeration system 10 itself. In practicing the method of operation of a refrigeration system, the steps include passing the refrigerant from an evaporator 20 to a primary compressor 31 in the heating mode for compressing the refrigerant and supplying the refrigerant to the condenser 40. The method then includes the step of controlling the exclusive operation of the primary compressor 31 by selecting the temperature range above which the primary compressor 31 is the sole means for compressing refrigerant. The inventor of the present invention has discovered that the preferred outdoor ambient temperature set point is between 20° and 30° F. The primary compressor 31 is used to operate exclusively in the heating mode above that temperature range. The method then includes passing the refrigerant from the evaporator 20 to both the primary compressor and a secondary compressor 32 while in the heating mode while operating below the determined outdoor ambient temperature set point such that the mass flow of the refrigerant through the refrigeration system in the heating mode is no greater than that of the cooling mode.

By referencing the performance table for the Bristol compressor model H26B15QCBC, illustrating capacity and mass flow for refrigerant R22, to be used in association with the primary compressor 31 and the performance table for the Bristol compressor model H26D36QBBC, also illustrating capacity and mass flow for refrigerant R22, to be used in association with dual compressor operation, the performance of the present invention may be illustrated.

Figure 6:
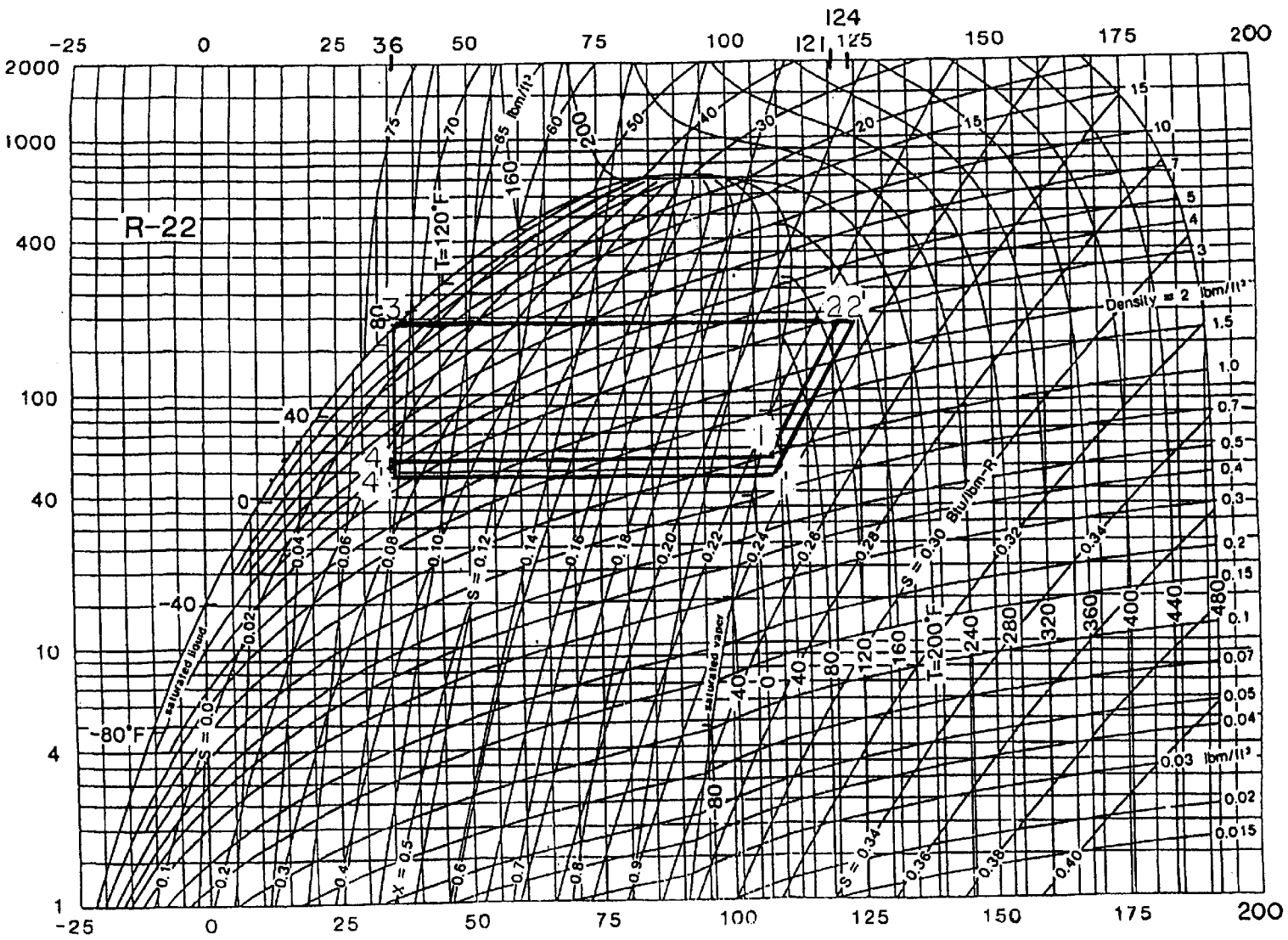
FIG. 6 illustrates the Pressure-Enthalpy diagram and associated data for one embodiment of the present invention.

When looking at FIG. 6, and applying the change in enthalpy across the condenser for one versus two compressor mass flows, as provided from two typical compressor performance tables, it can be seen that the mass flow for two compressor operation at low ambient temperatures (20° F. to 30° F.) where the evaporator temperatures are between (10° and 20° F.) is less than the mass flow of the lead compressor operating at typical extreme cooling performance evaporator temperatures (50° to 55° F.) (90° condenser temperature). Mass flow at 10° to 20° F. evaporator temperature for dual compressor operation for a 90° F. condenser temperature= 258.7 to 335.4 lb/hr mass flow. Mass flow at 50° to 55° F. evaporator temperature for a 90° condenser temperature for the lead compressor is only=286 to 314 lb/hr mass flow.

The capacity in cooling for the single (primary) compressor operating in the cooling mode would be approximately between 20,000 BTUH and 26,000 BTUH depending on the efficiency of the equipment. The capacity in the heating mode for the dual compressor operation operated at a 10° to 20° F. evaporator temperature would be approxomately between 21,000 BTUH and 28,000 BTUH, versus the capacity in heating for the lead compressor only, is approximately between 9,000 BTUH and 12,000 BTUH at the same evaporator temperatures.

The increase in capacity is due to two factors. An increase in Δh (change in enthalpy) across the condenser for dual (or multiple compressor) operation (Δh increases as evaporator temperature is lowered by increased compressor capacity) and an increase in mass flow due to increased compressor capacity.

$$\Delta h_1 \times \text{mass flow}_1 < \Delta h_2 \times \text{mass flow}_2 < \Delta h_N \times \text{mass flow}_N$$

For dual compressor operation at a 90° F. condensor and 10° F. evaporator, mass $\text{flow}_2$=258.7 lb/hr (performance chart for dual compressor operation) and $\Delta h_2$=124–36 (FIG. 6, h@2'→–h@3)=88.

$$\text{Capacity}_2 = 88 \times 258.7 = 22{,}766 \text{ BTUH}$$

For lead compressor operation only at a 90° condenser and 20° F. evaporator, mass $\text{flow}_1$=150.3 lb/hr (performance chart for primary compressor only) and $\Delta h_1$=121–36 (FIG. 6, h@2–h@3)=85.

$$\text{Capacity}_1 85 \times 150.3 = 12{,}776 \text{ BTUH.}$$

In use, the present invention may further comprise of the step of providing additional secondary compressors N such that the number of operating secondary compressors N increases as the temperature decreases below each predetermined outdoor ambient temperature set point for each additional secondary compressor required to maintain heating capacity in the heating mode. The method may then also include the step of alternating the exclusive operation in the cooling mode of at least one of the secondary compressors 32, 33 or N with the primary compressor 31.

The previously described embodiments of the present invention have many advantages, including maintaining the heat output constant as the ambient temperature outside continues to drop. Moreover, the entire refrigeration system is sized for only a single compressor in the cooling mode. While in the cooling mode, a compressor may switch operation with any other compressor so that the life expectancy of each of the compressors may be preserved.

For the purposes of illustrating the benefits of the present invention, the following are three sets of test data.

TEST 1

Evcon Model Number DRSH030 Baseline and Converted Lab test results on Dual Compressor System With Dual Coil/Evaporator with and without application of Dual Source Technology (air and geothermal)

| | | | HEAT | | COOL |
|---|---|---|---|---|---|
| Test Temp (Degrees F.) | 17 | 17 | 47 | 82 | 95 |
| #of Compressors | 2 | 1 | 1 | 1 | 1 |
| Equip. Type DRSH042 (Unmodified) Standard Evaporator Baseline | | | | | |
| Capacity (BTUH) | | 18500 | 30700 | 32200 | 31500 |
| COP/EER | | 2.35 | 3.45 | 12.53 | 11.18 |
| % Latent | | | | 28.80% | 23.80% |
| MODIFIED Dual Compressor With Dual Evaporator NO Glycol | | | | | |
| Capacity (BTUH) | 33000 | | 34000 | 44800 | 40600 |
| COP/EER | 2.5 | | 3.88 | 16.08 | 13.51 |
| % Latent | | | | 28.10% | 24.10% |
| Dual Compressor With Dual Coil/Evaporator 70 Deg. F. Glycol | | | | | |
| Capacity (BTUH) | 37600 | | 36600 | 51417 | 50969 |
| COP/EER | 2.76 | 4.01 | 19.83 | 17.4 | |
| % Latent | | | | 34.0% | 34.20% |
| Dual Compressor With Dual Coil/Evaporator 50 Deg. F. Glycol | | | | | |
| Capacity (BTUH) | 35100 | | 32700 | 54331 | 53882 |
| COP/EER | 2.62 | | 3.79 | 21.88 | 19.18 |
| % Latent | | | | 36.0% | 35.10% |

TEST 2

Evcon Model Number DRSH018 Baseline and Converted Lab test results on Dual Compressor System With Dual Coil/Evaporator with and without application of Dual Source Technology (air and geothermal)

| | | | HEAT | | COOL |
|---|---|---|---|---|---|
| Test Termp (Degrees F.) | 17 | 17 | 47 | 82 | 95 |
| #of Compressors | 2 | 1 | 1 | 1 | 1 |
| Equip. Type DRSH018 (Unmodified) Standard Evaporator Baseline H25b17 Compressor | | | | | |
| Capacity (BTUH) | | 11800 | 20200 | 21260 | 21500 |
| COP/EER | | 2.12 | 3.39 | 12.46 | 11.55 |
| % Latent | | | | 31.30% | 27.40% |
| MODIFIED Dual Compressor With Dual Evaporator NO Glycol Capacity | | | | | |

TEST 2-continued

Evcon Model Number DRSH018 Baseline and Converted Lab test results on Dual Compressor System With Dual Coil/Evaporator with and without application of Dual Source Technology (air and geothermal)

| | HEAT | | COOL | |
|---|---|---|---|---|
| (BTUH) | | | | |
| COP/EER | | | | |
| % Latent | | | | |
| Dual Compressor With Dual Coil/Evaporator 70 Deg. F. Glycol | | | | |
| Capacity (BTUH) | 27595 | 23424 | 30685 | 29937 |
| COP/EER | 2.99 | 4.42 | 20.72 | 17.76 |
| % Latent | | | 26.80% | 25.40% |
| Dual Compressor With Dual Coil/Evaporator 50 Deg. F. Glycol | | | | |
| Capacity (BTUH) | 24822 | 22508 | 33070 | 32228 |
| COP/EER | 2.8 | 4.34 | 23.11 | 20.31 |
| % Latent | | | 29.0% | 27.9% |

TEST 3

Evcon Model Nurnber DRSH042 Baseline and Converted Lab test results on Dual Compressor System With Dual Coil/Evaporator with and without application of Dual Source Technology (air and geothermal)

| | HEAT | | | COOL | |
|---|---|---|---|---|---|
| Test Temp (Degrees F.) | 17 | 17 | 47 | 82 | 95 |
| #of Compressors | 2 | 1 | 1 | 1 | 1 |
| Equip. Type DRSH042 (Unmodified) Standard Evaporator Baseline | | | | | |
| Capacity (BTUH) | | 25800 | 42500 | 45000 | 44000 |
| COP/EER | | 2.69 | 3.54 | 12.74 | 11.57 |
| % Latent | | | | 35.00% | 26.80% |
| MODIFIED Dual Compressor With Dual Evaporator NO Glycol | | | | | |
| Capacity (BTUH) | 35090 | 24607 | 38842 | 45543 | 42521 |
| COP/EER | 2.38 | 2.62 | 3.5 | 12.69 | 10.88 |
| % Latent | | | | 39.80% | 37.30% |
| Dual Compressor With Dual Coil/Evaporator 70 Deg. F. Glycol | Fixed Orifice Metering | | | | |
| Capacity (BTUH) | 45120 | | 45637 | 61635 | 61724 |
| COP/EER | 2.81 | | 3.99 | 16.4 | 15.2 |
| % Latent | | | | 38.0% | 37.1% |
| Dual Compressor With Dual Coil/Evaporator 50 Deg. F. Glycol | Fixed Orifice Metering | | | | |
| Capacity (BTUH) | 45011 | | 45377 | 6S211 | 64406 |
| COP/EER | 2.76 | | 3.96 | 18.3 | 16.2 |
| | | | | 41.0% | 40.00% |
| TXV Metering (BTUH/COP) | (46887/ 2.76) | | (46348/ 3.96) | | |

The present disclosure includes that contained in the appended claims, as well as that of the foregoing description. Although this invention has been described in its preferred form with a certain degree of particularity, it should be understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. In a refrigeration system of the type having a condenser, evaporator, refrigerant and the capabilities of at least heating and cooling modes of operation, a multiple compressor system in parallel operation comprising, in combination, a primary compressor and at least one secondary compressor, where the condenser and evaporator refrigerant are sized for the mass flow created by the primary compressor operating exclusively in the cooling mode at refrigerant condensing temperatures down to 80° F. and evaporator temperatures up to 55° F. as well as in the heating mode at refrigerant condensing temperatures down to 80° F. and evaporator temperatures up to 55° F. and where said secondary compressor commencing operation in the heating mode only when the outdoor temperature drops below a predetermined set point where the extra mass flow created by the secondary compressor will not exceed the mass flow limitations set for the system by the design criteria for the primary compressor operating exclusively in the heating and cooling modes as described above.

2. In a refrigeration system as claimed in claim 1 wherein at least one of said secondary compressors alternates exclusive operation in the cooling mode of operation with said primary compressor.

3. In a refrigeration system as claimed in claim 1 wherein said first outdoor ambient temperature set point is between approximately 20° and 30° F.

4. In the method of operation of a refrigeration system of the type having a condenser, evaporator, refrigerant and the capabilities of at least heating and cooling modes of operation, the method comprising the steps of:

passing the refrigerant from the evaporator of the refrigeration system to a primary compressor in the heating mode of operation for compressing the refrigerant and supplying same to the condenser of the refrigeration system, said primary compressor operating exclusively in the heating mode of operation above a mass flow related predetermined outdoor ambient temperature set point;

controlling the exclusive operation of said primary compressor by selecting said outdoor ambient temperature set point above which said primary compressor is the sole means for compressing refrigerant; and passing the refrigerant from the evaporator of the refrigeration system to said primary compressor and a secondary compressor sized for operation while in the heating mode of operation when below said outdoor ambient temperature set point such that the mass flow of the refrigerant through the refrigeration system in the heating mode of operation is no greater than the maximum design mass flow determined for the cooling mode of operation as described in claim 1.

5. In the method of operation of a refrigeration system as claimed in claim 4 further comprising of the step of providing at least one additional secondary compressor such that the number of operating secondary compressors increases as the mass flow decreases below said optimum mass flow determined as required in the heating mode of operation such that the mass flow of refrigerant through the refrigeration system in the heating mode of operation is no greater than the maximum design mass flow determined for the cooling mode of operation as described in claim 1.

6. In the method of operation of a refrigeration system as claimed in claim 5 further comprising of the step of alternating exclusive operation in the cooling mode of operation and in the heating mode of operation when above the first predetermined outdoor ambient temperature set point of at least one of said secondary compressors with said primary compressor.

7. In the method of operation of a refrigeration system as claimed in claim 4 further comprising of the step of alternating exclusive operation of said secondary compressor in the cooling mode of operation and in the heating mode of operation when above the first predetermined outdoor ambient temperature set point with said primary compressor.

8. In the method of operation of a refrigeration system as claimed in claim 4 wherein the refrigeration system is sized for the mass flow created by said primary compressor operating in the cooling mode of operation.

9. In the method of operation of a refrigeration system as claimed in claim 4 wherein said first outdoor ambient temperature set point is between approximately 20° and 30° F.

10. In a refrigeration system of the type having a condenser, evaporator, refrigerant and the capabilities of at least heating and cooling modes of operation, a multiple compressor system in parallel operation comprising, in combination, a primary compressor and at least one secondary compressor, the condenser and evaporator sized for operation with said primary compressor in the refrigeration system in the cooling mode of operation, said primary compressor operating exclusively in the heating mode above an outdoor ambient temperature set point of between approximately 20° and 30° F.; said secondary compressor commencing operation in the heating mode of operation when said outdoor ambient temperature falls below the predetermined set point and concurrently operating with said primary compressor such that the mass flow of the refrigerant through the refrigeration system in the heating mode of operation is no greater than that of the cooling mode of operation; said secondary compressor alternating exclusive operation in the cooling mode of operation and in the heating mode of operation above the first set point temperature with said primary compressor.

11. In a refrigerant system as claimed in claim 1 wherein the number of secondary compressors in parallel operation with said primary compressor increases to keep the mass flow of refrigerant up to the original design mass flow as described in claim 1 as the outdoor temperature continues to drop.

12. In a refrigerant system as claimed in claim 1 wherein each additional compressor begins operation in conjunction with said primary compressor at outdoor temperature intervals consistent with the need for additional mass flow as described in claim 1.

13. In a refrigerant system as claimed in claim 1 comprising an interconnecting conduit means for interconnecting said plurality of compressors for parallel operation within the refrigerant system.

* * * * *